US006004092A

United States Patent [19]

Johnson et al.

[11] Patent Number: 6,004,092

[45] Date of Patent: Dec. 21, 1999

[54] SWINGING ARM LOADING REFUSE COLLECTION VEHICLE ARM RESTRAINT

[75] Inventors: Gary L Johnson, Fort Payne, Ala.; Gary G Flerchinger, Hixson, Tenn.

[73] Assignee: The Heil Co., Chattanooga, Tenn.

[21] Appl. No.: 09/019,850

[22] Filed: Feb. 6, 1998

[51] Int. Cl.[6] ..... B65F 3/002

[52] U.S. Cl. ..... 414/408; 92/15; 92/24; 414/555

[58] Field of Search ..... 92/15, 17, 23, 92/24, 25, 27, 28; 212/292; 414/406, 407, 408, 421, 546, 555

[56] References Cited

U.S. PATENT DOCUMENTS

| | | | |
|---|---|---|---|
| 2,813,518 | 11/1957 | Driskel et al. | 92/24 |
| 3,576,151 | 4/1971 | Sendoykas | 92/24 |
| 4,073,345 | 2/1978 | Miller | 92/23 |
| 4,352,626 | 10/1982 | Frisbee et al. | 92/15 |
| 4,365,539 | 12/1982 | Martin | 92/17 |
| 4,566,840 | 1/1986 | Smith | 414/408 |
| 5,755,547 | 5/1998 | Flerchinger et al. | 414/408 |

*Primary Examiner*—Janice L. Krizek
*Attorney, Agent, or Firm*—Alan Ruderman; Miller & Martin

[57] ABSTRACT

A side loading refuse collection vehicle has a lift arm extendible and rotatable relative to the vehicle, the lift arm carrying grabber apparatus at an end for grasping a refuse container which may be lifted and dumped into the top of the body of the vehicle. The lift arm which is guided to move in a path so as to grasp the container, raise it, dump it and return it to its initial position, is driven toward and away from the vehicle by a first hydraulic drive cylinder and lifted and lowered by a second hydraulic drive cylinder. The first hydraulic drive cylinder has a drive rod on which a locking bolt is secured and may be captured in a receptacle of a keeper when the rod is in the fully retracted position to lock the arm against inadvertent and undesirable extension outwardly away from the vehicle. The keeper is pivotally mounted and moved by the output rod of a pneumatic cylinder to permit the bolt to be released from the receptacle when the hydraulic drive is activated. When the hydraulic drive rod is retracted to its fully retracted position, the keeper returns to the locking position to receive the locking bolt. This ensures that the arm does not inadvertently drift outwardly into traffic while the vehicle is driven should there be a failure of the hydraulic cylinder system.

17 Claims, 5 Drawing Sheets

SWINGING ARM LOADING REFUSE COLLECTION VEHICLE ARM RESTRAINT

BACKGROUND OF THE INVENTION

This invention relates to refuse collection vehicles of the type having an arm that carries container grabbing mechanism that may extend from the body of the vehicle to grasp a container, hoist it and dump its contents into the collection vehicle body, and return the container to its original position, and more particularly to apparatus for preventing the arm from inadvertently drifting outwardly from the vehicle by locking the arm extension drive when the arm is fully retracted.

Refuse collection vehicles are known which have an arm selectively extendible from the body of the vehicle and having grabbing or grasping apparatus at the end of the arm remote from the vehicle for clamping firmly about a refuse container. Associated with the arm is means for lifting the end of the arm including the grasping apparatus for dumping the contents of the container into a hopper at the top of the vehicle body. Such vehicles, known in the art as side loaders, have the obvious advantage in that only one person, to wit, a driver is necessary to collect refuse from a substantial number of dwellings or the like. The means for extending the arm includes a hydraulic drive cylinder with an extendible piston rod which permits the arm to be extended up to approximately 8 feet from the body so that a refuse container may be picked up in tight or difficult locations such as on the sidewalk of a street where the refuse vehicle may be prevented from getting close to the sidewalk because of parked vehicles and the like. The arm may be retracted fully so that the grasping apparatus is disposed substantially within the lateral confines of the body of the vehicle or in close proximity thereto thereby permitting the vehicle to be driven at highway speeds when necessary, such as when traveling to a dump site or the like.

A potential problem associated with the extendible lift arm is that which may occur should there be a failure of the arm extension drive means, e.g. the extension cylinder, the hydraulic circuit therefor or the electrical circuit controlling the operation of the hydraulic system. In such a situation the vehicle may be stopped by the driver of the vehicle and manually positioned if the arm is extended far enough from the vehicle to be seen from the cab by the driver. However, if the arm is not extended far enough so as to be viewable by the driver, the driver may not be aware of such failure and may drive the vehicle at speeds or conditions that would be hazardous to life and property. For example, the arm may spring outwardly due to centrifugal force while the driver is turning a corner or driving at less than relatively high speeds on a street or at high speeds on a highway. Should the arm extend in this manner to its full length an obviously dangerous situation is presented.

This problem was set forth in Flerchinger and Smith co-pending U.S. patent application Ser. No. 08/661,197 filed Jun. 10, 1996, now U.S. Pat. No. 5,755,547, and assigned to the common assignee of the instant invention. There, the lift arm is carried by a carriage which is slidably mounted on a track and retaining apparatus is provided for locking the carriage and thus the arm in various positions less than the fully retracted position of the carriage. The retaining apparatus includes a keeper plate movable with the carriage and a latch for seizing and holding the keeper when the carriage is not being driven.

Other extendible lift arm refuse vehicles utilize mechanisms which pivot or swing the arm relative to a fixed frame mounted on the vehicle. Here, there is no slidable carriage. Hydraulic cylinders act to extend and pivot the arm. The prior art attempted to address the problem resulting from a failure of the extension cylinder or its control by four known methods. One method utilized a chain and pin arrangement wherein the chain was looped around the arm to keep the arm fully retracted. This required the operator to physically disembark from the vehicle to install the chain and pin. The second method utilized friction cams and roller detents. This technique however, has been unsuccessful since the detent or friction is readily overcome as the vehicle bounces along a roadway or turns about a curve. Hydraulic detents within the hydraulic drive cylinder have been utilized but are found to wear rapidly and are unreliable and no visual inspection of the cylinder may be made to determine whether the detent is functioning properly. A pilot operated hydraulic check valve or counterbalance valve on the hydraulic drive cylinder has been utilized and although this corrects for a leaky valve or broken hose, if the hydraulic drive cylinder piston fails the arm will extend from the vehicle.

SUMMARY OF THE INVENTION

Consequently, it is a primary object of the present invention to provide apparatus which precludes the extendible swinging lift arm of a side loader refuse collection vehicle from inadvertently drifting outwardly from the body of the vehicle.

It is another object of the present invention to provide latching mechanism for locking the extendible lift arm of a side loader refuse collection vehicle in the fully retracted position until the arm is extended selectively by the driver of the vehicle.

It is a further object of the present invention to provide locking apparatus for locking the lift arm of a side loader refuse collection vehicle substantially in the fully retracted position by locking its drive mechanism against movement each time the arm is fully retracted so as to prevent the arm from drifting outwardly as the vehicle travels to and from the collection site.

Accordingly, the present invention provides a side loading refuse collection vehicle having an extendible lift arm carrying at the end thereof refuse container grasping apparatus for grasping a refuse container, the arm being extendible by a linear power drive rod and being rotatable to dump the refuse, the drive rod having a locking bolt or lug secured thereto and captured by a keeper when the rod and thus the arm is in the fully retracted position to lock the arm in the retracted position, the keeper decoupling from the bolt when the drive rod is operatively driven toward the extended position.

The arm is guided for movement along a path by a track which is pivotably moved by the rod as the rod is extended and retracted. The arm is also pivoted by a lifting power driven rod. The extension drive rod together with the lifting device provide the required forces to move the arm into position to grasp the refuse container, lift it to dump the refuse in the vehicle, return the container to its initial position, and reposition the arm to the stowed position. The locking bolt when the arm is in the stowed position is in its most retracted position and the keeper, which is located at this position, may be activated to either capture or release the bolt. In the preferred form of the invention, the extendible rod is the rod of a hydraulic cylinder and the keeper is actuated by a pneumatic cylinder activated to lock when the drive rod is fully retracted and to release the bolt when the drive rod is extended by the hydraulic cylinder.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
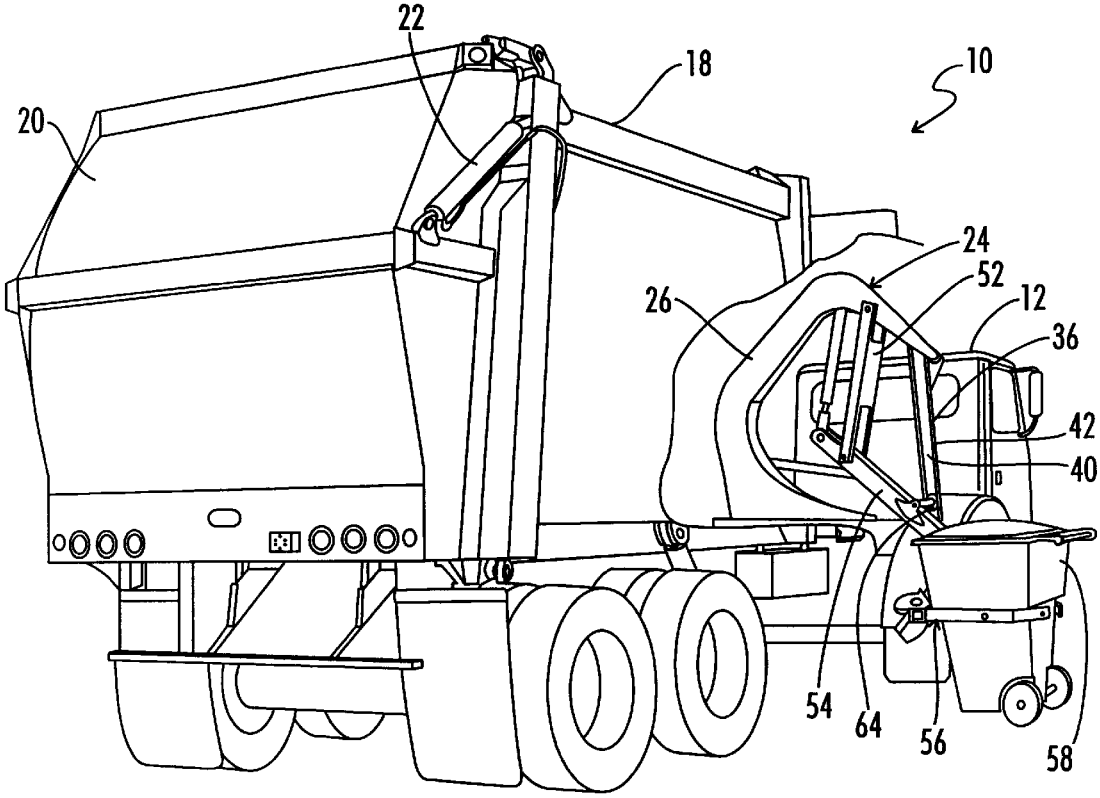
FIG. 1 is a rear perspective view of a side loader refuse collection vehicle of the present invention partly broken away with the lifting arm partially extended and the grasping apparatus clamped about a refuse container.
Figure 2:
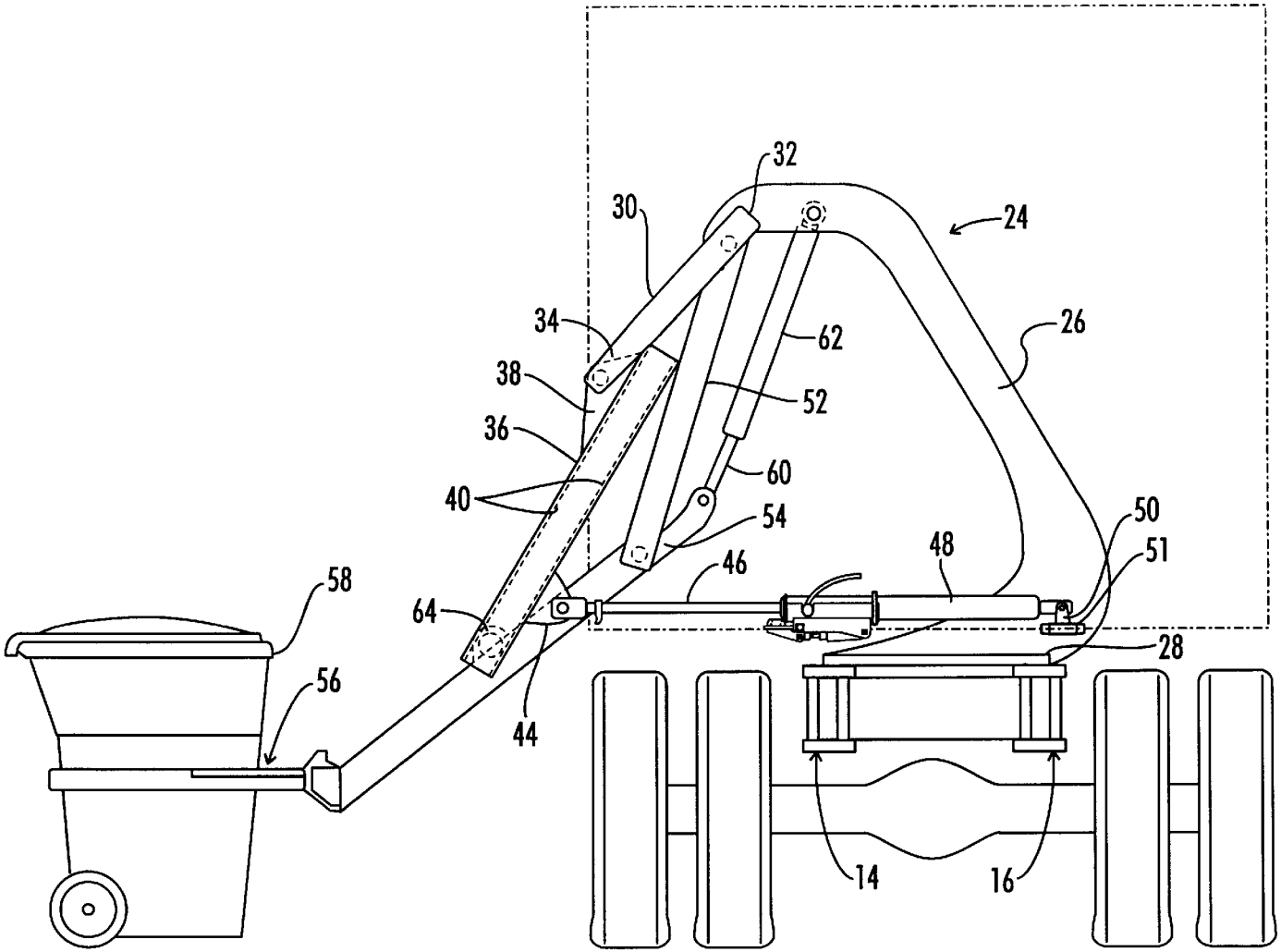
FIG. 2 is an enlarged elevational view of the side loading structure in the extended position and incorporating apparatus constructed in accordance with the present invention.

Referring now to the drawings, FIG. 1 illustrates a side loading refuse vehicle 10 conventionally having a cab 12 at the front, a chassis including longitudinally extending frame members 14, 16, illustrated in FIG. 2, and a refuse receiving body 18 being mounted on the chassis spaced behind the cab. The body has a refuse receiving hopper (not illustrated) at the top adjacent the front end and refuse may be deposited into the body through the hopper by side loading apparatus as herein after described. The refuse is there compacted by conventional apparatus within the body and conventionally expelled at the rear end, preferably by dumping, after the rear end 20 is hingedly opened and tilted by means of hydraulic cylinders 22 (only one of which is illustrated) at each side.

Side loading apparatus 24 is disposed adjacent the body intermediate the cab 12 and the body 18 mounted on the frame members 14, 16, the apparatus 24 including a lift frame 26. The frame 26 preferably comprises a substantially C-shaped unitary structure preferably bifurcated at its upper portion and having a base portion 28 fixedly mounted transversely across the frame members 14, 16 so that the lift frame 26 extends transversely. The lift frame 26 carries an extension 30 at the free end having one end 32 secured to the free end of the frame 26. The other end of the extension 30, which may be a unitary extension of the frame 26 itself if desired, has its other end 34 journally connected to an elongated substantially rectangular track housing 36 by means of an ear 38 secured to the track housing 36 so that the track housing may pivot relative to the extension 30 and thus the lift frame 26.

Figure 3:
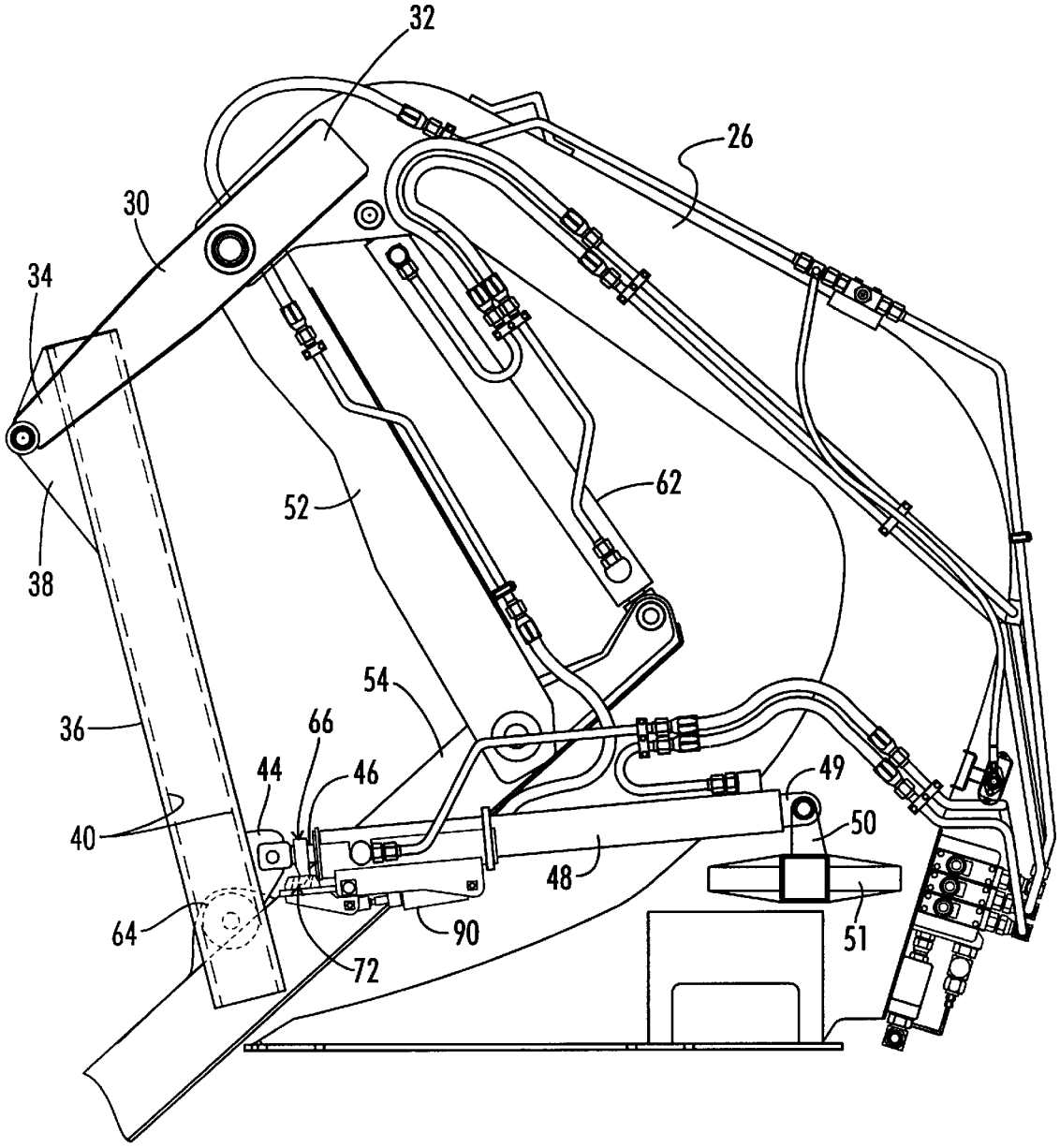
FIG. 3 is a more detailed view of the apparatus illustrated in FIG. 2, but with the arm in the retracted position.
Figure 4A:
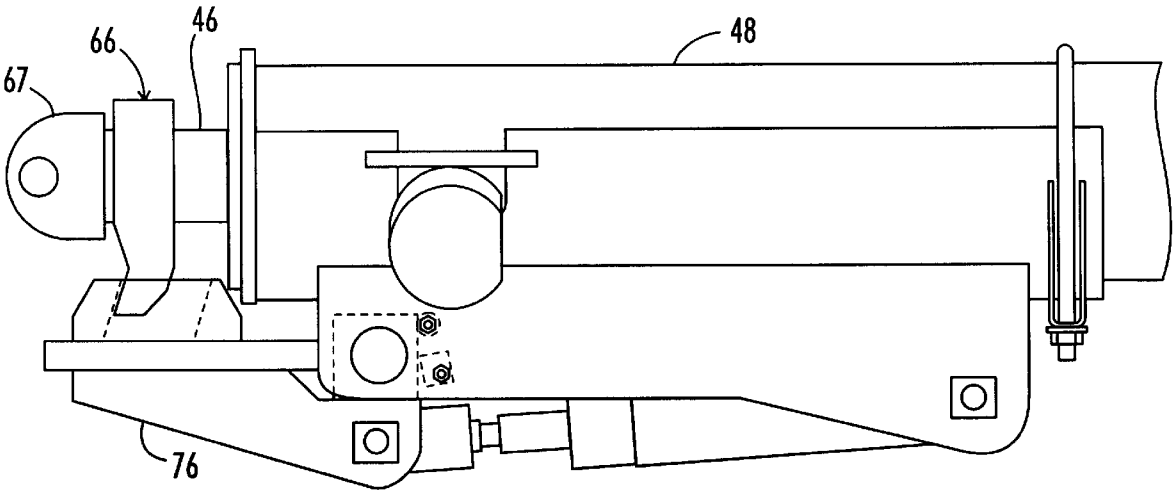
FIG. 4A is an enlarged view of a portion of the structure in FIG. 3 depicting the drive rod in the locked position.
Figure 4B:
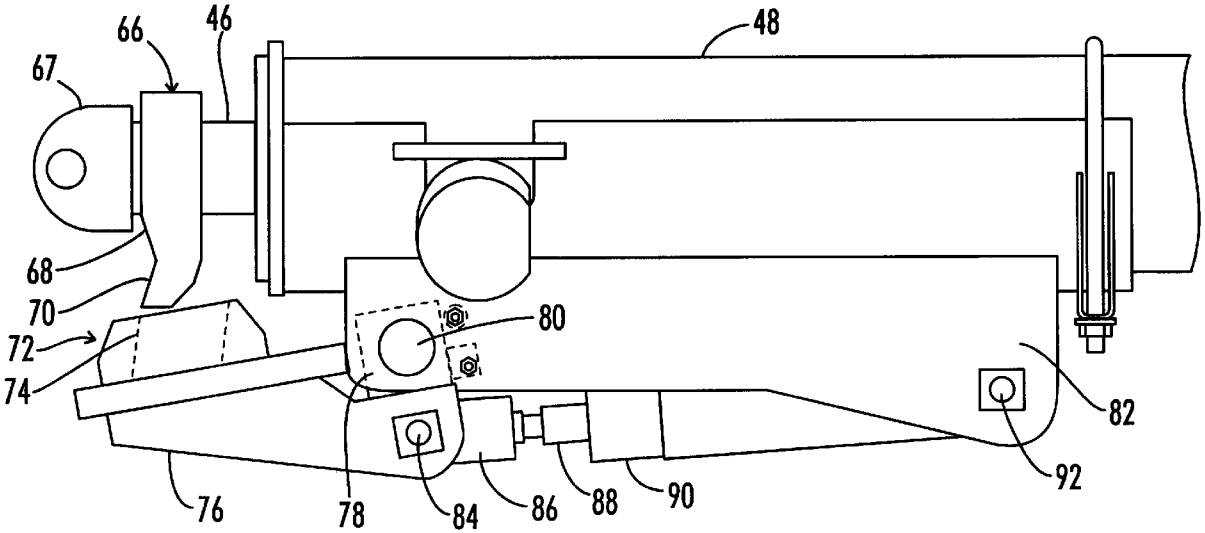
FIG. 4B is a view similar to FIG. 4A but with the drive rod released from the locking mechanism.

The track housing 36 has a linear track 40 formed between a pair of parallel flanges 42 best illustrated in FIG. 3. As hereinafter made clear the track acts to guide the lift arm in the desired path. Spaced from the end of the track housing 36 having the ear 38 is a second end of the track housing adjacent to which is a second ear 44 to which the end of a piston rod 46 of a hydraulic power cylinder 48, defined as the extension cylinder, is journally connected. The remote or head end of the cylinder 48 has a lug 49 journally connected between a pair of ears 50 extending upwardly from a bracket 51 welded to and extending outwardly from a wall of the lift frame 26 adjacent the lower portion.

Pivotally connected to the extension 30 of the lift frame 26 intermediate its ends 32, 34 is one end of a link 52 having its other end pivotally connected to and intermediate the ends of the lift arm 54 of the apparatus, the lift arm carrying conventional grabber assembly 56 at one end for grasping and releasing a refuse container 58 selectively, the grabber assembly and its operation being well known in the art and further description thereof is not deemed necessary. The lift arm 54 at the end remote from the grabber assembly is bifurcated and the end of a piston rod 60 is pivotally connected therebetween, the piston rod extending from a second hydraulic power cylinder 62 defined as the lift cylinder. The head end of the lift cylinder 62 is pivotally connected to the lift frame 26 intermediate the exterior surfaces of the bifurcated upper end thereof. Additionally, the lift arm 54 journally carries a rotatable roller 64 which is received within and rides in the track 40 of the track housing 36 so that the track guides the roller and thus the movement of the lift arm 54.

It should thus be clear that by actuating the extension cylinder 48 and the lift cylinder 62 the lift arm 54 may be manipulated to extend transversely of the collection vehicle body for grasping a refuse container, lifting the container over the hopper at the top of the vehicle body to dump the contents of the container, replacing the container to its initial position and to retract back to within the lateral confines of the refuse vehicle between the cab 12 and the body 18. FIGS. 1 and 2, for example, illustrate the linkage in its refuse container grasping position. When the lift cylinder 62 is then actuated to fully extend the piston rod 60, the arm will be lifted as the roller 64 rolls up the track 40. After the arm 54 has been returned to the container releasing position by retracting the piston rod 60 to its initial position illustrated in FIGS. 1 and 2 and the grabber assembly 56 has released the container, the cylinders 48 and 62 are actuated to substantially fully retract the respective piston rods 46, 60 to the position illustrated in FIG. 3, which is the position of the members while the vehicle 10 is driven to and from the dump site. In this situation it is highly undesirable for the lift arm 54 to drift out into traffic. However, this may occur should there be leakage of the valves, broken hydraulic hoses or other failure of the hydraulic system associated with the extension cylinder 48.

Accordingly, the present invention provides apparatus for preventing inadvertent extension of the lift arm 54. To this end the piston rod 46 is locked except when the extension cylinder 48 is positively actuated under the control of the vehicle operator. Thus, a locking member 66 is secured to the rod 46 preferably by welding to the rod or to the eye-lug 67 at the end of the rod. The locking member 66 includes a portion 68 which extends outwardly radially from the axis of the rod 46 and includes a locking lug or bolt 70. A keeper 72 in the form of a hollow receptacle 74 is positioned for receiving and releasing the lug 70 selectively from the hollow of the receptacle. The keeper receptacle is formed on a support base 76 which extends transversely relative to the hollow of the receptacle and includes an upstanding ear 78 pivotally journalled on a pin 80 mounted between a pair of brackets 82 which are secured as by welding to the side of the body of the extension cylinder 48 so that the receptacle 74 may receive and release the lug 70 as the keeper pivots in one direction or the other. The base 76 of the keeper is connected by a pin 84 to a lug 86 attached to the exterior end of the piston rod 88 of a cylinder 90 having its head end pivotally connected by a pin 92 between the brackets 82. Preferably, the cylinder 90 is a pneumatic cylinder, but may if desired, be hydraulic. Air may be applied to the cylinder 90 to force the rod 88 outwardly and air may be bled from the cylinder and the rod retracted by a return spring within the cylinder, or the air may force the piston into the cylinder and bled to extend the piston. Since the receptacle 74 is offset relative to the center of the cylinder 90, it is found to be highly desirable to make the mating surfaces of the locking bolt 70 and the interior of the receptacle 74 at an angle to the axis of the cylinder 90 to thereby create a force vector that overcomes the moment or torque created by the moment resulting from the offset of the receptacle 74 from the axis of the cylinder 90. The mating surface angle may be adjusted to offset the moments about the pivot pin 80.

Figure 5:
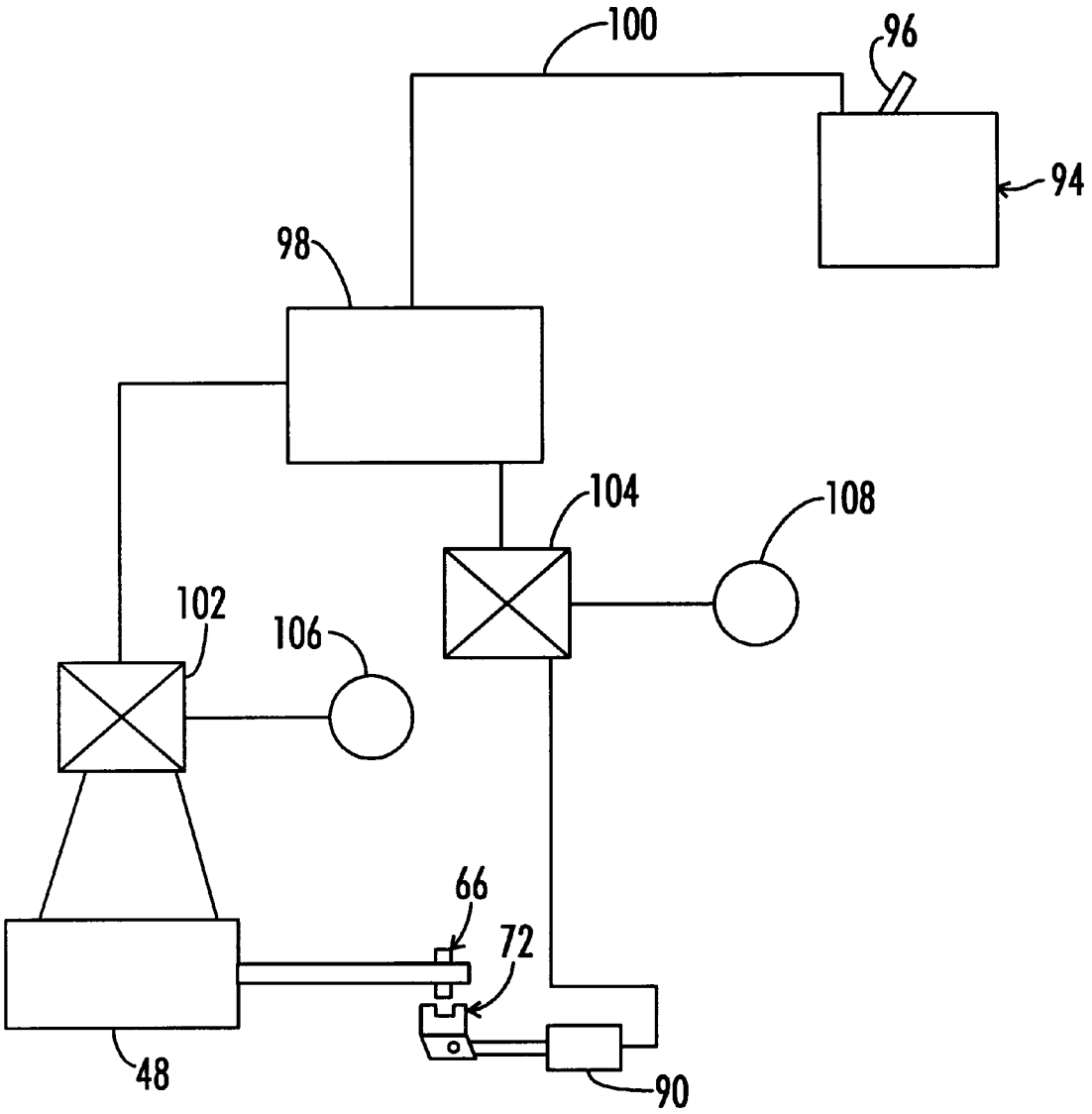
FIG. 5 is a schematic view illustrating a control system for the present invention.

A control system for the locking apparatus is illustrated schematically in FIG. 5. A controller 94 within the cab of the vehicle has paddles for actuating the various hydraulic cylinders, such as paddle 96 for the extension cylinder 48. Electrical signals from the controller 94 are transmitted to and from an electrical controller 98 through circuitry 100, the controller providing signals to a hydraulic solenoid valve 102 and a pneumatic solenoid valve 104 to operate the extension cylinder 48 and the lock control cylinder 90 respectively by means of the hydraulic fluid in a reservoir 106 and compressed air from a compressor 108 of the vehicle. The pneumatic system preferably operates quicker than the hydraulic system so that the lock control cylinder releases the keeper 72 from the bolt 70 before hydraulic force may be applied to the locking mechanism. Of course, if there is sufficient structure in the lock system to handle full hydraulic cylinder force, the pneumatic system need not operate quicker. The extension cylinder 48 is thereafter operated in its conventional manner until the operator releases the cylinder control paddle 96. At that time the pneumatic cylinder solenoid valve 104 is actuated to reposition the keeper 72 to capture the locking lug 70. In all other respects, the extension cylinder together with the other hydraulic cylinders of the system operate conventionally.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a side loading refuse collection vehicle including a refuse receiving body, a lift arm having grabber apparatus for grasping a refuse container to raise it in a path to dump refuse into a top portion of said body and return the container along said path, and means including an extension cylinder having a rod extendible therefrom and retractable therein selectively for moving said lift arm in said path, the improvement comprising apparatus for preventing undesirable extension of said extension rod until said extension cylinder is actuated to drivingly extend said rod, said apparatus including a locking member secured to said rod, and a keeper disposed for retaining said locking member unless said extension cylinder is actuated to drivingly extend said rod.

2. In a side loading refuse collection vehicle as recited in claim 1, wherein said locking member comprises a bolt extending away from the path in which said rod travels relative to said extension cylinder, and said keeper includes a receptacle in which said bolt is disposed until said extension cylinder is actuated to extend said rod.

3. In a side loading refuse collection vehicle as recited in claim 2, wherein said receptacle is formed in a support base, and said keeper includes a drive member for moving said support base away from the path in which said rod travels to release said bolt when said extension cylinder is actuated to extend said rod and for moving said support base toward the path in which said rod travels to position said receptacle for receiving said bolt when said rod is not extended relative to said extension cylinder.

4. In a side loading refuse collection vehicle as recited in claim 3, wherein said drive member comprises a fluid driven rod of a drive cylinder actuated upon actuation of said extension cylinder to extend its rod.

5. In a side loading refuse collection vehicle as recited in claim 4, wherein said extension cylinder is hydraulically driven and said drive rod is pneumatically driven.

6. In a side loading refuse collection vehicle as recited in claim 3, wherein said support base is mounted for pivotal movement relative to said bolt to release said bolt upon actuation of said extension cylinder to extend said rod.

7. In a side loading refuse collection vehicle as recited in claim 6, wherein said drive member comprises a fluid driven rod of a drive cylinder actuated upon actuation of said extension cylinder to extend its rod.

8. In a side loading refuse collection vehicle as recited in claim 7, wherein said extension cylinder is hydraulically driven and said drive cylinder is pneumatically driven.

9. In a side loading refuse collection vehicle as recited in claim 8, wherein said bolt and said receptacle have abutting surfaces disposed at an angle relative to the path in which said rod travels and relative to the axis of said drive cylinder.

10. In a side loading refuse collection vehicle including a longitudinally extending vehicle frame, a body carried by said frame for receiving refuse in a top portion thereof, a lifting frame supported by said vehicle frame, an extension cylinder pivotally connected to said lifting frame and having an extension rod extendible from said extension cylinder upon actuation of said extension cylinder, said extension rod having a free end external of said cylinder, a lift cylinder pivotally connected to said lifting frame and having a lift rod extendible from said lift cylinder upon actuation of said lift cylinder, said lift rod having a free end external of said lift cylinder, a link having a first end pivotally connected to said lifting frame and a second end, a lift arm pivotally connected to said second end of said link and to said free end of said lift rod and carrying refuse container grabber means for clasping about a refuse container, and a guide for directing said lift arm in a path in which said grabber means may be extended to grasp a container and thereafter raise the container above said body and return the container to its initial position upon extension and retraction of said extension and lift rods, the improvement comprising apparatus for preventing undesirable extension of said extension rod until said extension cylinder is actuated to drivingly extend said extension rod, and said apparatus including a locking member secured to said extension rod, and a keeper disposed for retaining said locking member unless said extension cylinder is actuated to drivingly extend said rod.

11. In a side loading refuse collection vehicle as recited in claim 10, wherein said locking member comprises a bolt extending away from the path in which said extension rod travels relative to said extension cylinder, and said keeper includes a receptacle in which said bolt is disposed until said extension cylinder is actuated to extend said extension rod.

12. In a side loading refuse collection vehicle as recited in claim 11, wherein said receptacle is formed in a support base, and said keeper includes a drive member for moving said support base away from the path in which said extension rod travels to release said bolt when said extension cylinder is actuated to extend said extension rod and for moving said support base toward the path in which said extension rod travels to position said receptacle for receiving said bolt when said extension rod is not extended relative to said extension cylinder.

13. In a side loading refuse collection vehicle as recited in claim 12, wherein said drive member comprises a fluid driven rod of a drive cylinder actuated upon actuation of said extension cylinder to extend said extension rod.

14. In a side loading refuse collection vehicle as recited in claim 12, wherein said support base is mounted for pivotal movement relative to said bolt to release said bolt upon actuation of said extension cylinder to extend said extension rod.

15. In a side loading refuse collection vehicle as recited in claim 14, wherein said drive member comprises a fluid driven rod of a drive cylinder actuated upon actuation of said extension cylinder to extend said extension rod.

16. In a side loading refuse collection vehicle as recited in claim 15, wherein said extension cylinder is hydraulically driven and said drive cylinder is pneumatically driven.

17. In a side loading refuse collection vehicle as recited in claim 16, wherein said bolt and said receptacle have abutting surfaces disposed at an angle relative to the path in which said rod travels and extension relative to the axis of said drive cylinder.

* * * * *